United States Patent [19]

Christophorou et al.

[11] Patent Number: 4,490,650

[45] Date of Patent: Dec. 25, 1984

[54] GAS MIXTURE FOR DIFFUSE-DISCHARGE SWITCH

[75] Inventors: Loucas G. Christophorou, Oak Ridge; James G. Carter, Knoxville; Scott R. Hunter, Oak Ridge, all of Tenn.

[73] Assignee: The United States of America as represented by the United States Department of Energy, Washington, D.C.

[21] Appl. No.: 413,588

[22] Filed: Aug. 31, 1982

[51] Int. Cl.[3] ..... H05B 37/02

[52] U.S. Cl. ..... 315/150; 315/358

[58] Field of Search ..... 315/150, 358; 307/117, 307/139; 313/637, 643

[56] References Cited

U.S. PATENT DOCUMENTS 4,063,130 12/1977 Hunter, Jr. ..... 315/150

OTHER PUBLICATIONS

Executive Summary, Workshop on Repititive Opening Switches, Dept. of Elect. Eng., Texas Tech. Univ., Jan. 28-30, 1981.

Schoenback et al., Proc. 3rd IEEE International Pulsed Power Conference, Albuquerque, N.M., Jun. 1-3, 1981.

Alexeff, *Simple High-Voltage Opening Switch Using Spoiled Electrostatic Confinement,* IEEE Tran. Plasma Sci., vol. PS-8, No. 3, Sep. 1980, pp. 163-185.

IEEE Transactions on Plasma Science, vol. PS-8, No. 3, Sep. 1980, pp. 129-142.

*Primary Examiner*—David K. Moore

*Attorney, Agent, or Firm*—Edwin D. Grant; Stephen D. Hamel

[57] ABSTRACT

Gaseous medium in a diffuse-discharge switch of a high-energy pulse generator is formed of argon combined with a compound selected from the group consisting of $CF_4$, $C_2F_6$, $C_3F_8$, n-$C_4F_{10}$, $WF_6$, $(CF_3)_2S$ and $(CF_3)_2O$.

4 Claims, 8 Drawing Figures

GAS MIXTURE FOR DIFFUSE-DISCHARGE SWITCH

BACKGROUND OF THE INVENTION

This invention, which resulted from a contract with the U.S. Department of Energy, relates to gas mixtures advantageous for use in a diffuse-discharge switch of an inductive energy storage system.

In certain applications such as high-power microwave sources, pulsed lasers, particle beam generators, nuclear event simulators, and directional energy weapons, it is necessary to store electrical energy for release in pulses having extremely short durations. For this purpose an inductive-type storage system has a higher potential for storage of electrical energy than a capacitive-type storage system, but one of the problems which must be solved in the operation of the former is that the rapid opening of a diffuse-discharge switch used for transferring energy from a storage loop to a load induces a high voltage across the switch, which tends to maintain a conducting arc in a gas between the switch electrodes. What is needed to solve this problem is a gas mixture which has the capability for conducting a large amount of energy between the electrodes of a diffuse-discharge switch when the switch is in a conducting mode and which has a high insulating capability when the switch is in a nonconducting mode.

SUMMARY OF THE INVENTION

It is an object of this invention to provide an improved diffuse-discharge switch system for use in generating high-energy electrical pulses.

Another object of the invention is to provide a diffuse-discharge switch having a gas mixture therein which conducts a large amount of electrical energy when activated by an ionization beam but which serves as an effective insulator when not activated by the ionization beam.

In accordance with the invention these objects are achieved by an inductive energy storage system comprising a diffuse-discharge switch containing argon and a compound selected from the group consisting of $CF_4$, $C_2F_6$, $C_3F_8$, n-$C_4F_{10}$, $WF_6$, $(CF_3)_2S$ and $(CF_3)_2O$, and means for selectively activating the gas mixture in said switch to an electrical conductive state.

DETAILED DESCRIPTION OF PREFERRED EMBODIMENTS OF THE INVENTION

Figure 1:
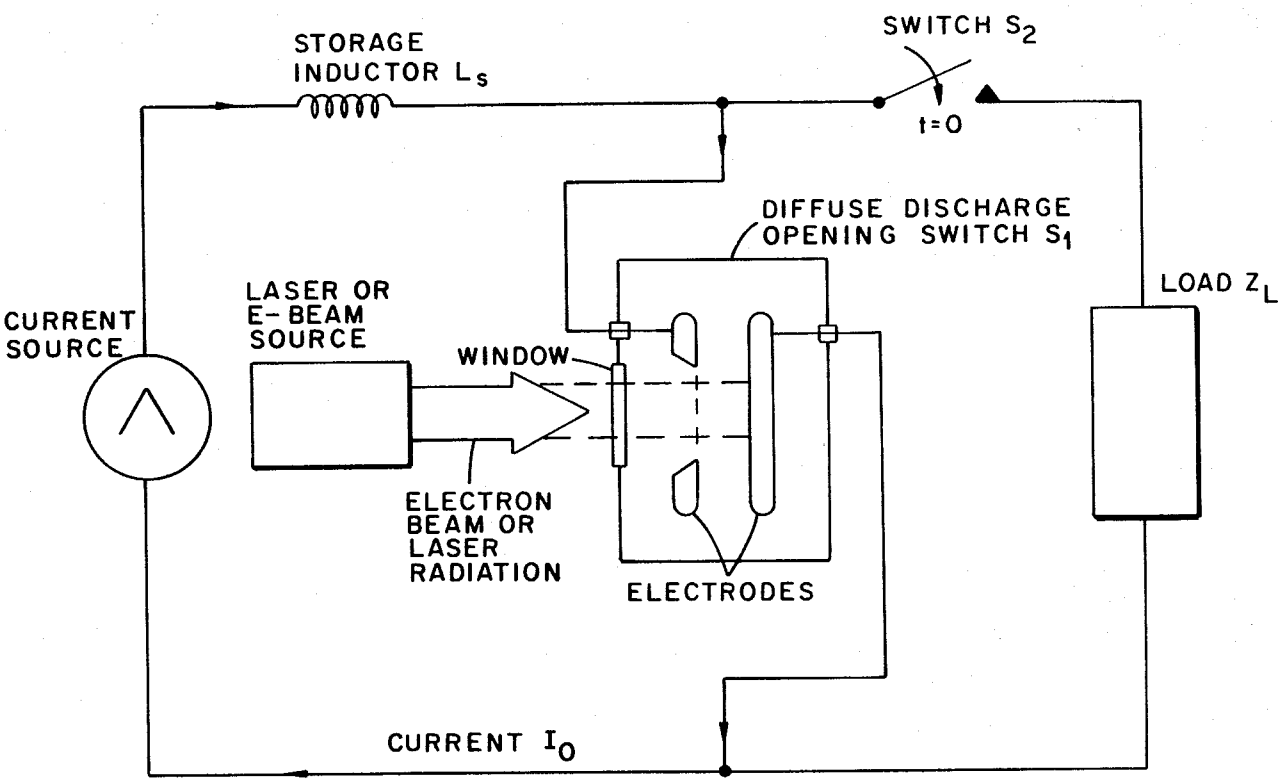
FIG. 1 is a schematic representation of an inductive-type energy discharge system of the type in which the invention can be advantageously employed.
Figure 2:
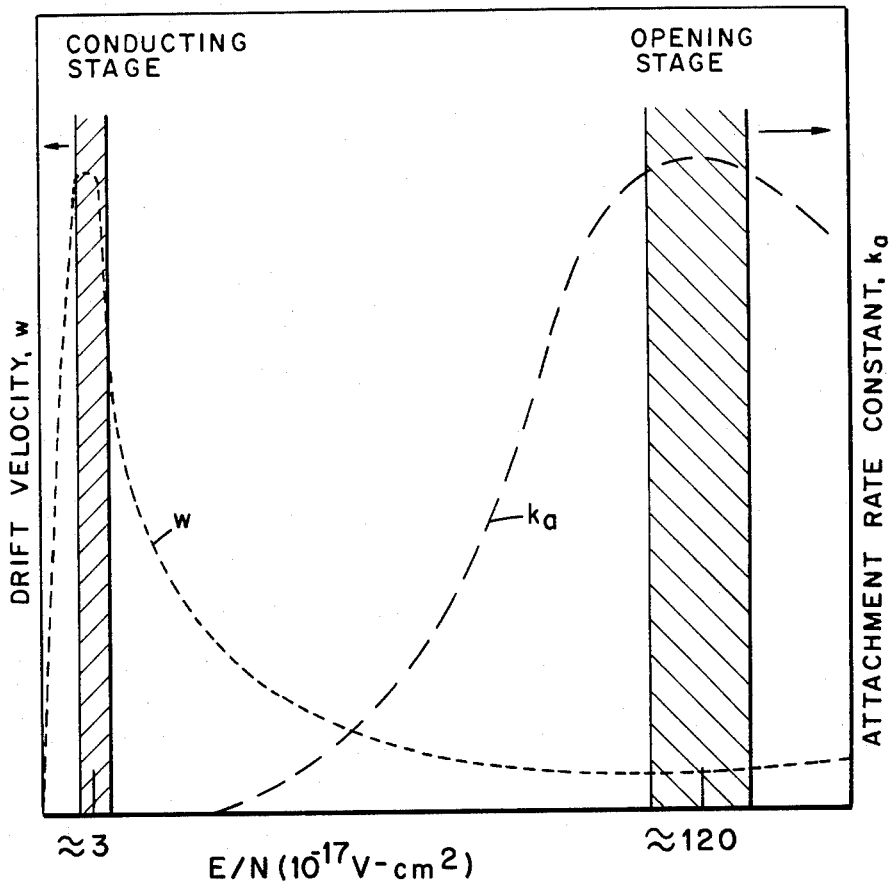
FIG. 2 is a diagram illustrating desirable characteristics of a gaseous medium in a diffuse-discharge switch.

The basic requirements of a gaseous medium for use in a diffuse-discharge switch of an inductive-type pulse generating system can best be understood by consideration of the operation of the circuit illustrated in FIG. 1. In a first operational mode of the system, switch $S_2$ is open as illustrated and the gaseous medium in switch $S_1$ is conducting current by means of a diffuse discharge sustained by irradiation of the gaseous medium with a suitable beam b from a pulsed source s of electrons or laser energy. In this stage of operation, the has number density N of the conducting medium and the voltage E applied across the electrodes of $S_1$ must be such that for the resulting E/N, the electron drift velocity w in the medium is maximal and the electron attachment rate constant $k_a$ of the medium is minimal. In a second operational mode of the system, the irradiation of the gaseous medium in $S_1$ by the electron or laser beam b is terminated, $S_2$ is closed to allow energy stored in inductor L to be transferred to load Z, and $S_1$ is open. A very large voltage is thus induced across $S_1$, equal to the inductance of L times di/dt, where i represents current flowing between the electrodes of $S_1$. The gaseous medium in $S_1$ therefore must possess characteristics which optimize current flow between the electrodes of the switch during the conduction phase of operation and also must be capable of effectively terminating current flow between the electrodes when a high voltage is impressed thereon as $S_2$ is closed. In the conductive phase of the operation of $S_1$, the value of E/N for the gaseous current conducting medium in the switch is low and, as stated hereinbefore, the electron drift velocity w of the medium must be maximal and the electron attachment rate constant $k_a$ of the medium must be minimal. When $S_2$ is closed, requirements for the gaseous medium are reversed; E/N is high, w must be minimal, and $k_a$ must be maximal. The shaded areas and the curves designated w and $k_a$ in FIG. 2 graphically depict the desired characteristics of the gaseous medium in $S_1$ during the two stages of operation which have been discussed.

Figure 3:
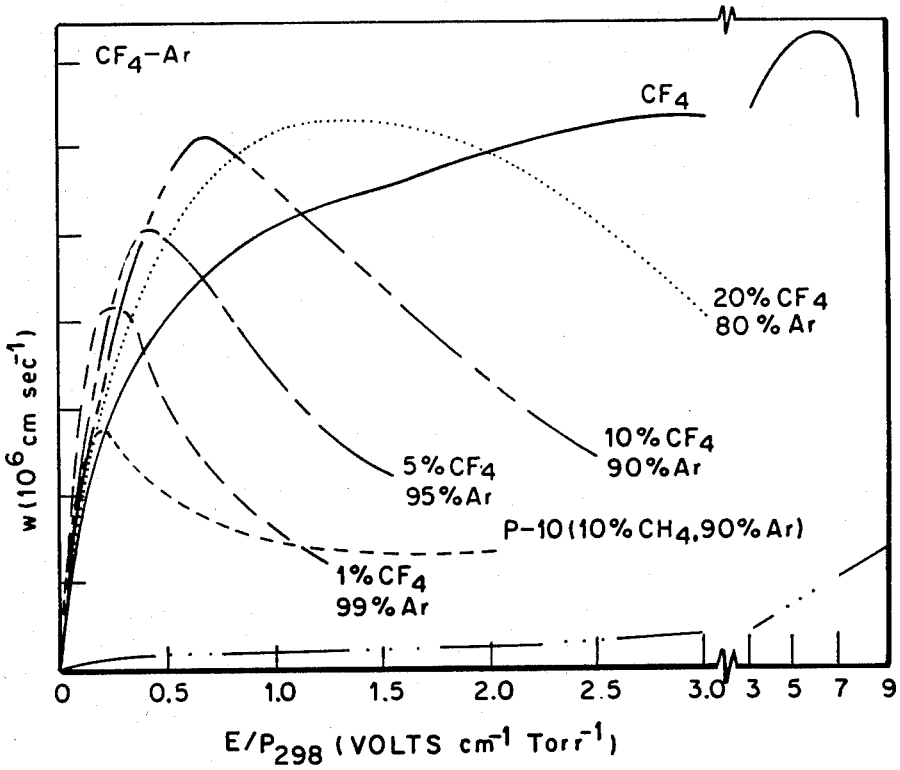
FIG. 3 is a graph showing electron drift velocity (w) versus E (voltage)/P (gas pressure at specific temperature) for Ar, $CF_4$, and mixtures of Ar and $CF_4$.
Figure 4:
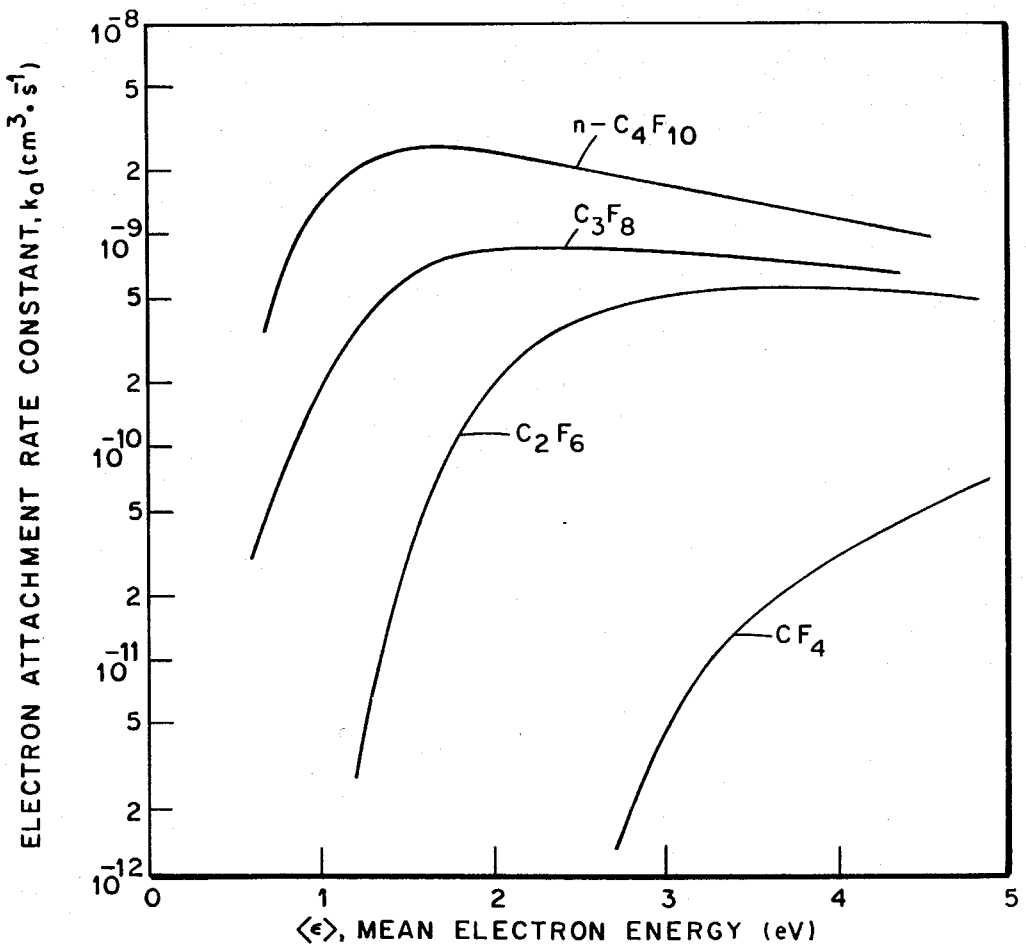
FIG. 4 is a graph showing electron attachment rate constants ($k_a$) as a function of mean electron energy for the perfluoroalkane series, $CnF_2N+2$ where N=1 to 4.
Figure 5:
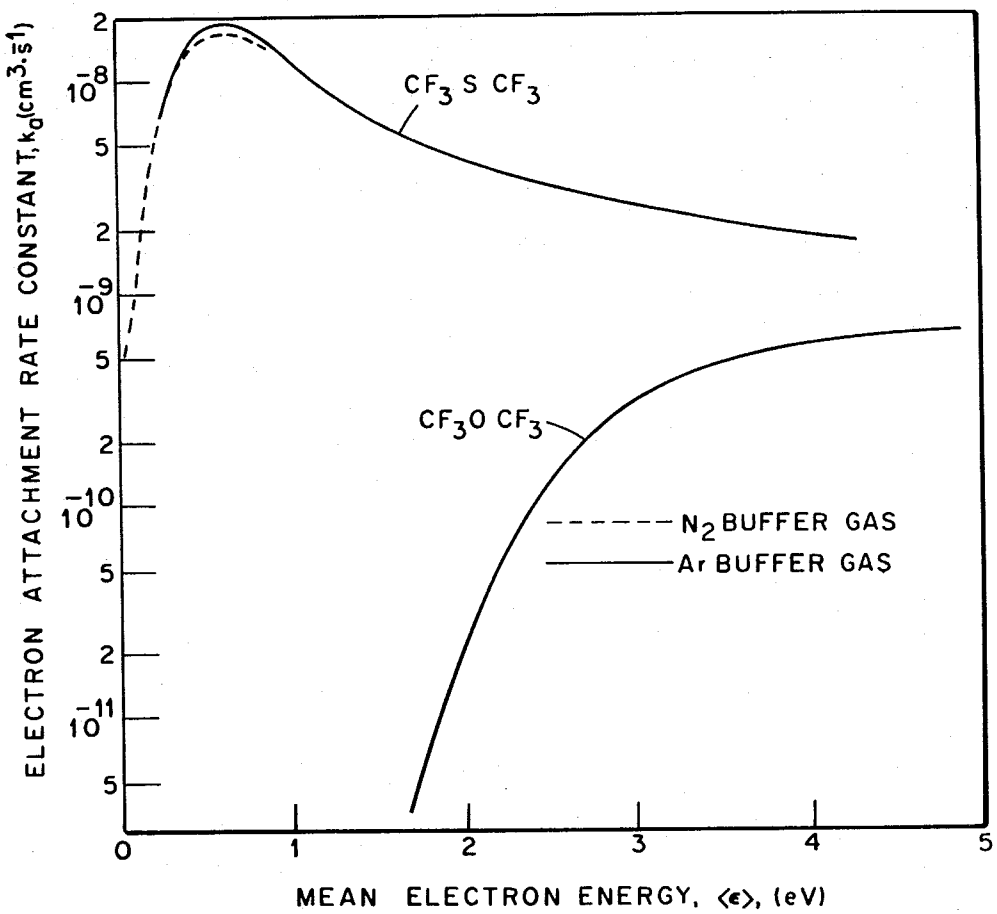
FIG. 5 is a graph showing electron attachment rate constants ($k_a$) as a function of the mean electron energy for the perfluorinated ethers $CF_3SCF_3$ and $CF_3OCF_3$.

The inventors have discovered that gas mixtures having the desired characteristics for effective use in $S_1$ during both its conducting and opening stages of operation can be provided by combining argon with a compound selected from the group consisting of $CF_4$, $C_2F_6$, $C_3F_8$, n-$C_4F_{10}$, $WF_6$, $(CF_3)_2$ and $(CF_3)_2O$. FIG. 3 shows the characteristics of mixtures of argon and $CF_4$ which are free of electron attachment at low values of E/N. It should be noted here that abscissa values in FIG. 3 are given for E/P at a temperature of 298° F. for different mixtures of Ar and $CF_4$. However, these values of E/P are proportionate to E/N values for the gas mixtures. By use of the data shown in FIG. 3, a mixture of Ar and $CF_4$ can be selected so as to maximize the electron drift velocity of the medium in $S_1$, in its conducting stage. Note that at high values of E/N, w of the Ar—$CF_4$ mixtures is reduced significantly, a desired property for the opening stage of the switch. Further, to be effective for the opening stage of $S_1$, the gaseous medium must effectively remove electrons by electron attachment, forming negative ions. In the opening stage of $S_1$, E/N is very high., therefore the gas must be capable of removing electrons well in excess of thermal energy. To accomplish this, a third gas which attaches electrons at energies greater than thermal energies may be mixed with the fast gas mixture of Ar and $CF_4$. Several such gases are shown in FIGS. 4 and 5. Note especially $(CF_3)_2S$ which captures electrons strongly above thermal energies and which itself is an excellent gaseous dielectric having a direct current uniform field breakdown strength 1.5 times that of $SF_6$. A mixture consisting of about 80% Ar, 10% $CF_4$ and 10% $(CF_3)_2S$ by volume will provide an effective medium for the operation of $S_1$.

However, it is preferable in most applications to use a binary gas mixture rather than a ternary mixture in $S_1$. The inventors have identified certain gases which, when mixed with argon, may serve as both a fast gas (similar to $Ar/CF_4$ mixtures) and as a gaseous dielectric having a high electron attachment coefficient. Gases suitable for this application include $C_2F_6$, $C_3F_8$, n-$C_4F_{10}$, $(CF_3)_2O$, and $WF_6$. For example, although the value of $k_a$ for $C_3F_8$ is lower in magnitude than for $(CF_3)_2S$, $k_a$ for $C_3F_8$ has a very desirable electron energy dependence as shown in FIG. 4; i.e., $k_a$ is small at low electron energies and large at high electron energies.

Figure 6:
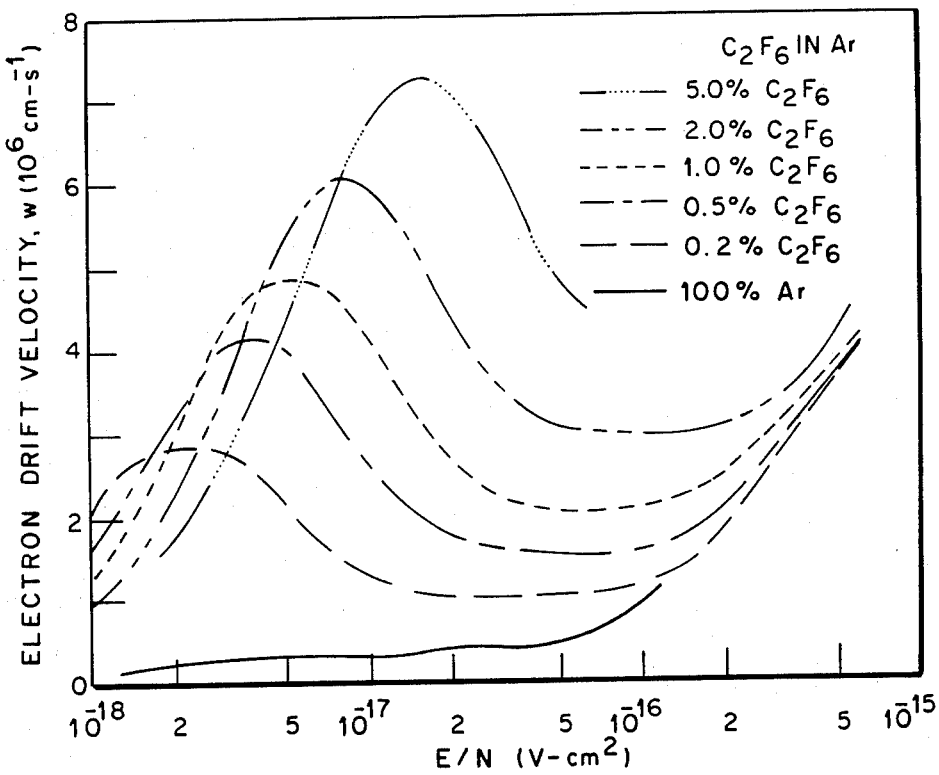
FIG. 6 is a plot of w versus E/N for mixtures of Ar and $C_2F_6$.
Figure 7:
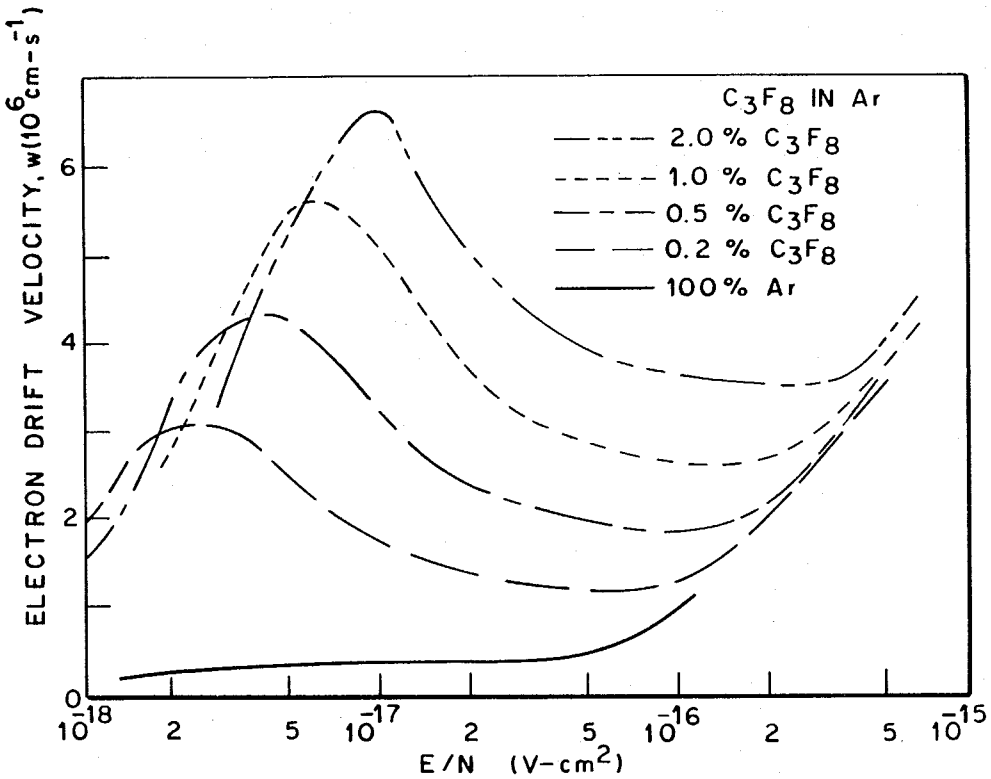
FIG. 7 is a plot of w versus E/N for mixtures of Ar and $C_3F_8$.

Measurements of w as a function of (E/N) using Ar and $C_2F_6$ and Ar and $C_3F_8$ mixtures have been made and are shown in FIGS. 6 and 7. The observed large w values and sharply peaked w(E/N) functions in the E/N range characteristic of the conducting stage of the switch, the high sensitivity of the w(E/N) functions to the percentage of $C_2F_6$ or $C_3F_8$ present in the mixture, and the decline in w with increasing E/N are all desirable characteristics of a gas suitable for use in a diffuse-discharge switch.

Figure 8:
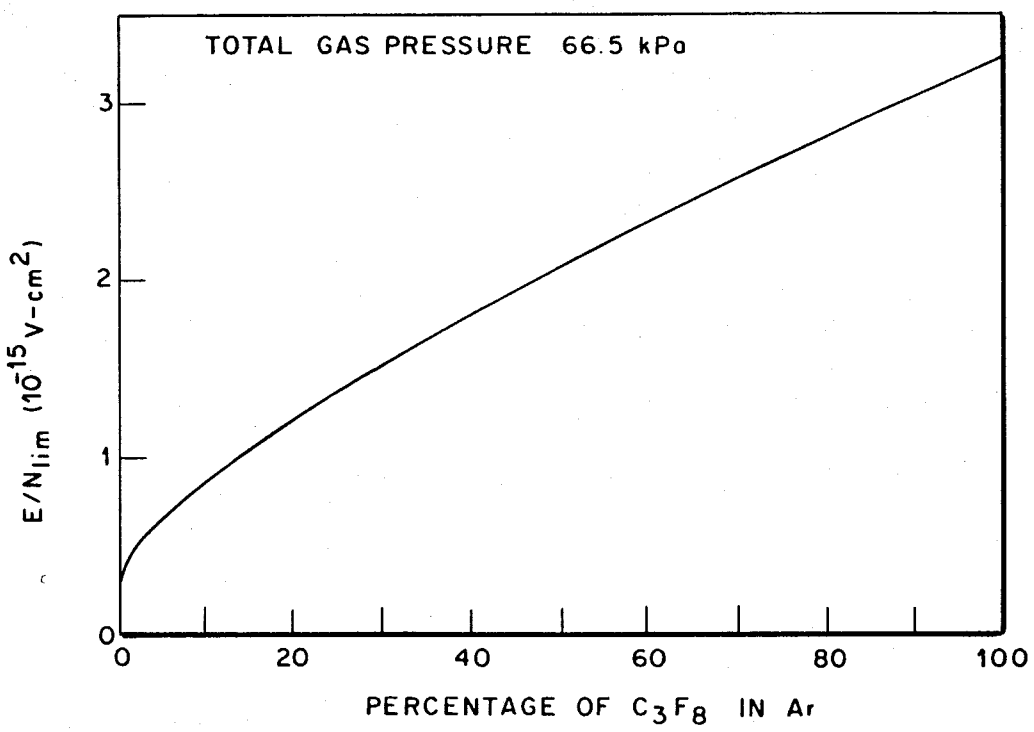
FIG. 8 is a plot of the limit value of E/N at which conduction occurs for different mixtures of Ar and $C_3F_8$.

Measurements have been made (see FIG. 8) of the direct current uniform field breakdown voltages of $Ar/C_3F_8$ mixtures. On the basis of the data shown in FIG. 8, $Ar/C_3F_8$ mixtures containing 15 to 20% $C_3F_8$ can withstand the voltage levels characteristic of the opening stage of the switch. They are therefore well suitable for use in a pulse generator in accordance with the principles of this invention.

What is claimed is:

1. An inductive energy storage system comprising:

a diffuse-discharge switch;

a binary gas mixture in said diffuse-discharge switch comprising Ar and a compound selected from the group consisting of $C_2F_6$, $C_3F_8$, n-$C_4F_{10}$, $WF_6$, and $(CF_3)_2O$; and means for selectively activating said gas mixture to an electrical conductive state.

2. The system of claim 1 wherein said gas mixture comprises Ar and $C_3F_8$.

3. The system of claim 1 wherein said gas mixture comprises Ar and $C_2F_6$.

4. The system of claim 2 wherein said gas mixture comprises 15 to 20% $C_3F_8$ by volume.

* * * * *